US006368186B1

(12) United States Patent
Wu

(10) Patent No.: US 6,368,186 B1
(45) Date of Patent: Apr. 9, 2002

(54) APPARATUS FOR MOUNTING A ROTATIONAL DISK

(75) Inventor: Kun-Tai Wu, Hsin-Chu (TW)

(73) Assignee: Taiwan Semiconductor Manufacturing Company, Ltd, Hsin Chu (TW)

( * ) Notice: Subject to any disclaimer, the term of this patent is extended or adjusted under 35 U.S.C. 154(b) by 0 days.

(21) Appl. No.: 09/765,934

(22) Filed: Jan. 19, 2001

(51) Int. Cl.[7] ..... B24B 1/00
(52) U.S. Cl. ..... 451/28; 451/285; 451/443
(58) Field of Search ..... 451/28, 41, 56, 451/59, 443, 444, 285, 286, 287, 288, 289

(56) References Cited

U.S. PATENT DOCUMENTS 5,904,615 A * 5/1999 Jeong et al. ..... 451/443
6,033,290 A * 3/2000 Gurusamy ..... 451/56
6,193,587 B1 * 2/2001 Lin et al. ..... 451/56
6,200,199 B1 * 3/2001 Gurusamy et al. ..... 451/56
6,217,429 B1 * 4/2001 Hoey ..... 451/443

* cited by examiner

*Primary Examiner*—Joseph J. Hail, III
*Assistant Examiner*—Dung Van Nguyen
(74) *Attorney, Agent, or Firm*—Tung & Associates

(57) ABSTRACT

An apparatus and a method for mounting a conditioning disk to a conditioning head for use in a chemical mechanical polishing apparatus. A torroidal-shaped bearing mount is fixedly mounted to a conditioning arm of the CMP apparatus for receiving a ball bearing and a cylinder rotator. A cylinder shaft is mounted inside a cylinder chamber defined by the cylinder rotator and is further equipped with a piston mounted at near a top end of the shaft which has an elastomeric gasket mounted on an outer rim for sealingly engaging a sidewall in the cylinder chamber. A disk holder is mounted to a bottom end of the cylinder shaft by a universal connector/universal mount such that the disk holder, with a conditioning disk mounted thereon, can be operated to follow a contour of the polishing disk by tilting to an angle of at least ±30° from a horizontal plane.

20 Claims, 5 Drawing Sheets

APPARATUS FOR MOUNTING A ROTATIONAL DISK

FIELD OF THE INVENTION

The present invention generally relates to an apparatus and a method for mounting a rotational disk and more particularly, relates to an apparatus and a method for mounting a conditioning disk onto a conditioning head for use in a chemical mechanical polishing apparatus that is capable of preventing slurry from being siphoned into the control system.

BACKGROUND OF THE INVENTION

Apparatus for polishing thin, flat semi-conductor wafers is well-known in the art. Such apparatus normally includes a polishing head which carries a membrane for engaging and forcing a semiconductor wafer against a wetted polishing surface, such as a polishing pad. Either the pad, or the polishing head is rotated and oscillates the wafer over the polishing surface. The polishing head is forced downwardly onto the polishing surface by a pressurized air system or, similar arrangement. The downward force pressing the polishing head against the polishing surface can be adjusted as desired. The polishing head is typically mounted on an elongated pivoting carrier arm, which can move the pressure head between several operative positions. In one operative position, the carrier arm positions a wafer mounted on the pressure head in contact with the polishing pad. In order to remove the wafer from contact with the polishing surface, the carrier arm is first pivoted upwardly to lift the pressure head and wafer from the polishing surface. The carrier arm is then pivoted laterally to move the pressure head and wafer carried by the pressure head to an auxiliary wafer processing station. The auxiliary processing station may include, for example, a station for cleaning the wafer and/or polishing head, a wafer unload station, or a wafer load station.

More recently, chemical-mechanical polishing (CMP) apparatus has been employed in combination with a pneumatically actuated polishing head. CMP apparatus is used primarily for polishing the front face or device side of a semiconductor wafer during the fabrication of semiconductor devices on the wafer. A wafer is "planarized" or smoothed one or more times during a fabrication process in order for the top surface of the wafer to be as flat as possible. A wafer is polished by being placed on a carrier and pressed face down onto a polishing pad covered with a slurry of colloidal silica or alumina in de-ionized water.

A schematic of a typical CMP apparatus is shown in FIGS. 1A and 1B. The apparatus 20 for chemical mechanical polishing consists of a rotating wafer holder 14 that holds the wafer 10, the appropriate slurry 24, and a polishing pad 12 which is normally mounted to a rotating table 26 by adhesive means. The polishing pad 12 is applied to the wafer surface 22 at a specific pressure. The chemical mechanical polishing method can be used to provide a planar surface on dielectric layers, on deep and shallow trenches that are filled with polysilicon or oxide, and on various metal films. CMP polishing results from a combination of chemical and mechanical effects. A possible mechanism for the CMP process involves the formation of a chemically altered layer at the surface of the material being polished. The layer is mechanically removed from the underlying bulk material. An altered layer is then regrown on the surface while the process is repeated again. For instance, in metal polishing a metal oxide may be formed and removed repeatedly.

A polishing pad is typically constructed in two layers overlying a platen with the resilient layer as the outer layer of the pad. The layers are typically made of polyurethane and may include a filler for controlling the dimensional stability of the layers. The polishing pad is usually several times the diameter of a wafer and the wafer is kept off-center on the pad to prevent polishing a non-planar surface onto the wafer. The wafer is also rotated to prevent polishing a taper into the wafer. Although the axis of rotation of the wafer and the axis of rotation of the pad are not collinear, the axes must be parallel.

The polishing pad is a consumable item used in a semiconductor wafer fabrication process. Under normal wafer fabrication conditions, the polishing pad is replaced after about 12 hours of usage. Polishing pads may be hard, incompressible pads or soft pads. For oxide polishing, hard and stiffer pads are generally used to achieve planarity. Softer pads are generally used in other polishing processes to achieve improved uniformity and smooth surface. The hard pads and the soft pads may also be combined in an arrangement of stacked pads for customized applications.

A problem frequently encountered in the use of polishing pads in oxide planarization is the rapid deterioration in oxide polishing rates with successive wafers. The cause for the deterioration is known as "pad glazing" wherein the surface of a polishing pad becomes smooth such that the pad no longer holds slurry in-between the fibers. This is a physical phenomenon on the pad surface not caused by any chemical reactions between the pad and the slurry.

To remedy the pad glazing effect, numerous techniques of pad conditioning or scrubbing have been proposed to regenerate and restore the pad surface and thereby, restoring the polishing rates of the pad. The pad conditioning techniques include the use of silicon carbide particles, diamond emery paper, blade or knife for scrapping the polishing pad surface. The goal of the conditioning process is to remove polishing debris from the pad surface, re-open the pores, and thus forms micro-scratches in the surface of the pad for improved life time. The pad conditioning process can be carried out either during a polishing process, i.e. known as concurrent conditioning, or after a polishing process.

A conventional conditioning disc for use in pad conditioning is shown in FIG. 1C in a perspective view of a CMP apparatus 50. The apparatus 50 consists of a conditioning head 52 which includes a conditioning disc 68 mounted to a hub frame 70, a polishing pad 56, and a slurry delivery arm 54 positioned over the polishing pad. The conditioning head 52 is mounted on a cover ring 58 which is extended over the top of the polishing pad 56 for making sweeping motion across the entire surface of the pad. The slurry delivery arm 54 is equipped with slurry dispensing nozzles 62 which are used for dispensing a slurry solution on the top surface 60 of the polishing pad 56. Surface grooves 64 are further provided in the top surface 60 to facilitate even distribution of the slurry solution and to help entrapping undesirable particles that are generated by coagulated slurry solution or any other foreign particles which have fallen on top of the polishing pad during a polishing process.

FIG. 2 shows a cross-sectional view of the conditioning head 52 of FIG. 1C. The conditioning head 52 is constructed by a bearing mount 42, a ball-bearing 44, a cylinder rotator 46, and a cylinder shaft 48. The bearing mount 42 and the ball-bearings 44 are mounted stationarily, while the cylinder rotator 46 and the cylinder shaft rotate when driven by a pulley 40. A pneumatic conduit 52 is utilized to supply a pressure onto the cylinder shaft 48 such that a conditioning disk 54 is pushed downwardly onto the surface of a polishing pad to be conditioned. The pneumatic conduit 52 further supplies a negative pressure, i.e. a vacuum onto the cylinder shaft 48, when the conditioning motion of the conditioning disk 54 is to be stopped and that the conditioning disk 54 is to be disengaged from the surface of the polishing pad. An elastomeric diaphragm 36 is used to provide a fluid seal between the cylinder shaft 48 and the cylinder rotator 46 to prevent the back flow of polishing slurry into the pneumatic conduit 52.

In the conventional design of the polishing head shown in FIG. 2, numerous design deficiencies have been discovered which may lead to serious processing difficulties. For instance, firstly, the conditioning head may have a short lifetime of less than one month, due to a breakage or fracture of the elastomeric diaphragm in the conditioning head due to the fact that the diaphragm is continuously moved inwardly and downwardly during disengagement and engagement of the conditioning head from and to a polishing pad. Secondly, since there is not a reliable method for detecting when the elastomeric diaphragm may fail or break, unstable downward pressure on the conditioning head frequently results which leads to inconsistent conditioning results. Thirdly, when the elastomeric diaphragm fractures or breaks, slurry solution may be siphoned back into the vacuum system to block the vacuum conduits, the pneumatic valves and the vacuum source. Fourthly, since the conditioning head is mechanically fixed to the cylinder shaft and that the available space between the two is very small, it is difficult to remove and replace the diamond disk mounted on the conditioning disk when necessary.

It is therefore an object of the present invention to provide an apparatus for mounting a rotational disk to a stationary bearing mount with ball-bearings that does not have the drawbacks or shortcomings of the conventional apparatus.

It is another object of the present invention to provide an apparatus for mounting a conditioning disk in a conditioning head in a chemical mechanical polishing apparatus that does not have a reliability problem.

It is a further object of the present invention to provide an apparatus for mounting a conditioning disk in a conditioning head for a chemical mechanical polishing apparatus which utilizes a cylinder shaft and a piston affixed to the shaft for preventing any leakage of slurry solution through the conditioning head.

It is another further object of the present invention to provide an apparatus for mounting a conditioning disk in a conditioning head for a chemical mechanical polishing apparatus wherein a cylinder shaft is equipped with a universal connector for connecting to a disk holder for the conditioning disk.

It is still another object of the present invention to provide an apparatus for mounting a conditioning disk in a conditioning head for a chemical mechanical polishing apparatus wherein a universal connector is used to mount the conditioning disk allowing a tilting motion of the conditioning disk.

It is yet another object of the present invention to provide an apparatus for mounting a conditioning disk in a conditioning head for a chemical mechanical polishing apparatus in which a piston and a gasket is utilized to prevent any possible leakage of a slurry solution through the conditioning head.

It is still another further object of the present invention to provide an apparatus for mounting a conditioning disk in a conditioning head for a chemical mechanical polishing apparatus wherein the use of an elastomeric diaphragm between a cylinder shaft and a cylinder rotator is eliminated.

It is yet another further object of the present invention to provide a method for mounting a conditioning disk in a conditioning head for a chemical mechanical polishing apparatus by mounting a cylinder shaft to a cylinder rotator through a piston and a gasket and a disk holder to the cylinder shaft by a universal connector.

SUMMARY OF THE INVENTION

In accordance with the present invention, an apparatus and a method for mounting a conditioning disk in a conditioning head for a chemical mechanical polishing apparatus are provided.

In a preferred embodiment, an apparatus for mounting a conditioning disk in a chemical mechanical polishing apparatus is provided which includes a torroidal-shaped bearing mount for fixedly mounting to a conditioning arm in a CMP apparatus, the torroidal-shaped bearing mount is adapted for receiving a ball bearing and a cylinder rotator that turns on the ball bearing; a cylinder rotator that has a cylinder chamber therein defined by a top wall and a bottom wall with center apertures therethrough for receiving a cylinder shaft; a cylinder shaft that has a piston mounted juxtaposed to a top end and a universal connector at a bottom end, the cylinder shaft may be mounted through the center apertures of the cylinder rotator, the piston may further include a gasket for sealing between the piston and an interior surface of the cylinder chamber wall; a disk holder for mounting to the universal connector on the cylinder shaft through a universal mount located in a top surface of the disk holder such that the disk holder may tilt and follow the contour of a polishing pad through a conditioning disk mounted thereon while rotated by the cylinder rotator; and a pneumatic means for applying to the cylinder shaft and for enabling an up-and-down motion of the cylinder shaft.

In the apparatus for mounting a conditioning disk in a CMP machine, the piston frictionally engages the interior chamber wall of the cylinder rotator by the gasket. The gasket on the piston may be fabricated of an elastomeric material for providing frictional engagement between the piston and the interior chamber wall of the cylinder rotator. The apparatus may further include a diamond disk mounted to a bottom surface of the disk holder. The apparatus may further include a pulley for driving the cylinder rotator and causing it to rotate. The universal connector enables the disk holder to tilt at least ±30° from a horizontal plane. The cylinder rotator, the cylinder shaft and the disk holder rotate as a single unit. The pneumatic means is operable by an air pressure of at least 5 psi for pressing the disk holder downwardly to engage a diamond disk to a polishing pad. The pneumatic means may be operable by air pressure of not higher than −10 psi for moving the disk holder upwardly to disengage a diamond disk from a polishing pad. The ball bearing may be fixedly mounted to the bearing mount on a conditioning arm.

The present invention is further directed to a method for mounting a conditioning head in a chemical mechanical polishing machine which can be carried out by the operating steps of first providing a torroidal-shaped bearing mount fixedly mounted to a conditioning arm in a CMP apparatus; providing a cylinder rotator that has a cylinder chamber therein defined by a top wall and a bottom wall with center apertures for receiving a cylinder shaft; mounting the cylinder rotator to the bearing mount with a ball bearing therein-between; providing a cylinder shaft that has a piston fixed thereon juxtaposed to a top end and a universal connector at a bottom end, the piston may further include a gasket for sealing between the piston and an interior surface of the cylinder chamber wall; mounting the cylinder shaft inside the cylinder rotator through the center apertures in the top wall and the bottom wall with the gasket frictionally engaging the interior surface of the cylinder chamber wall; providing and mounting a disk holder to the universal connector on the cylinder shaft by a universal mount located at a center of the disk holder such that the disk holder tilts and follows the contour of a polishing pad with a conditioning disk mounted thereon and when the disk holder is rotated by the cylinder shaft; and applying a pneumatic pressure to the cylinder shaft and moving the cylinder shaft in an up-and-down motion.

The method for mounting a conditioning head in a CMP apparatus may further include the step of mounting the gasket on an outer rim of the piston, or the step of fabricating the gasket from an elastomeric material and providing a fluid seal for slurry solution between the piston and the interior chamber wall of the cylinder rotator, or the step of mounting a diamond disk to a bottom surface of the disk holder. The method may further include the step of rotating the cylinder rotator by a pulley. The universal connector enables the disk holder to tilt to a maximum of at least ±30° from a horizontal plane. The method may further include the step of rotating the cylinder rotator, the cylinder shaft and the disk holder together as a single unit, or the step of applying a pneumatic pressure of at least 5 psi for pressing the disk holder downwardly to engage a diamond disk to a polishing pad, or the step of applying a pneumatic pressure of not higher than −10 psi for moving the disk holder upwardly to disengage a diamond disk from a polishing pad. The method may further include the step of fixedly mounting the ball bearing to the bearing mount on the conditioning arm.

BRIEF DESCRIPTION OF THE DRAWINGS

These and other objects, features and advantages of the present invention will become apparent from the following detailed description and the appended drawings in which.

DETAILED DESCRIPTION OF THE PREFERRED EMBODIMENT

Figure 1A:
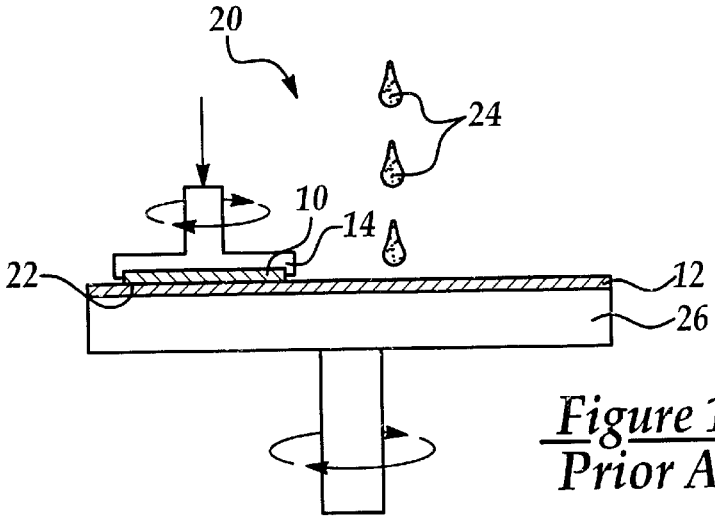
Figure 1A Prior Art
FIG. 1A is a cross-section illustrating a conventional chemical mechanical polishing apparatus.
Figure 1B:
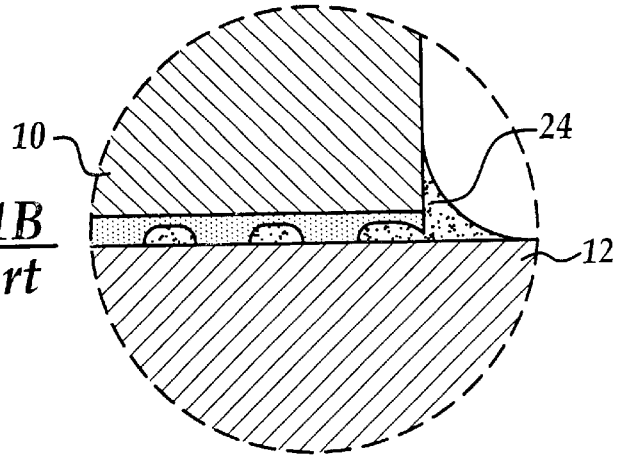
Figure 1B Prior Art
FIG. 1B is a partial, enlarged, cross-sectional view showing the slurry interaction between a wafer surface and a polishing pad.
Figure 1C:
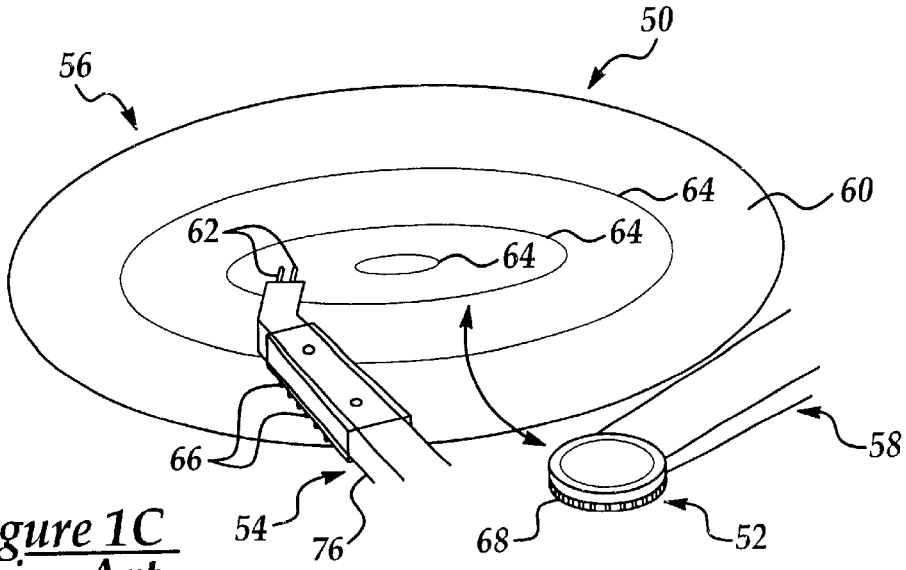
Figure 1C Prior Art
FIG. 1C is a perspective view of a polishing pad with a conditioning head positioned on top.
Figure 2:
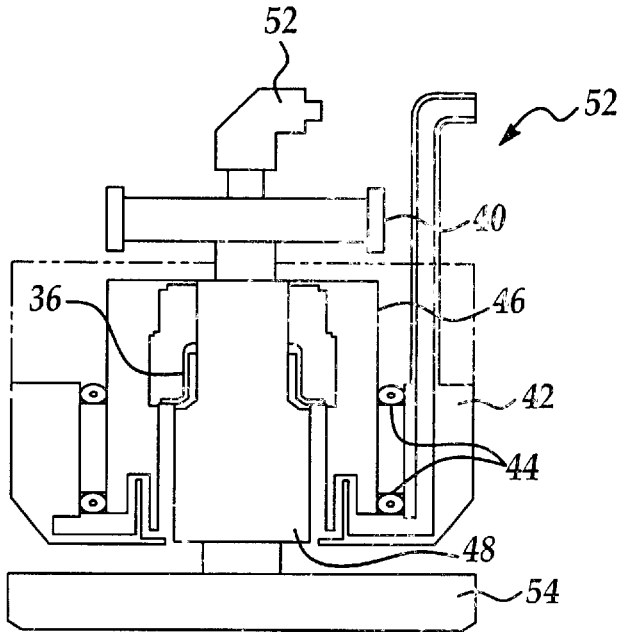
Figure 2 Prior Art
FIG. 2 is a cross-sectional view of a conventional conditioning head of FIG. 1C.

The present invention discloses an apparatus for mounting a conditioning disk to a conditioning head for use in a chemical mechanical polishing apparatus which includes a torroidal-shaped bearing mount, a ball bearing, a cylinder rotator, a cylinder shaft equipped with a piston, a disk holder and a pneumatic means. The torroidal-shaped bearing mount is fixedly mounted to a conditioning arm of a CMP apparatus and is adapted for receiving a ball bearing and a cylinder rotator that turns on the ball bearing. The cylinder rotator has a cylinder chamber therein defined by a sidewall, a top wall and a bottom wall wherein the top wall and the bottom wall have center apertures therethrough for receiving a cylinder shaft. The cylinder shaft has a piston mounted near a top end and a universal connector at a bottom end. The cylinder shaft is mounted through the center apertures of the cylinder rotator, while the piston further includes a gasket for sealingly engaging the piston to the interior surface of the cylinder chamber sidewall. The disk holder is mounted to the universal connector on the cylinder shaft through a universal mounting device provided in a top surface of the disk holder such that the disk holder may tilt and follow the contour of a polishing pad through a conditioning disk mounted on the holder while rotated by the cylinder rotator. The pneumatic means, which may be an air pressure and a vacuum source is used for applying a pressure or a vacuum to the cylinder shaft for enabling an up-and-down motion of the cylinder shaft.

In another aspect of the present invention, a method for mounting a conditioning disk to a conditioning head in a CMP apparatus is provided. The method can be carried out by first providing a torroidal-shaped bearing mount that is fixedly mounted to a conditioning arm in the CMP apparatus. A cylinder rotator is then provided which has a cylinder chamber therein defined by a sidewall, a top wall and a bottom wall with center apertures provided in the top wall and in the bottom wall for receiving a cylinder shaft. The cylinder rotator is then mounted to the bearing mount with a ball bearing therein, while a cylinder shaft is provided which has a piston fixed near a top end and a universal connector at the bottom end. The piston may further include a gasket for sealingly engaging the piston and an interior surface of the cylinder chamber sidewall. The cylinder shaft is then mounted inside the cylinder rotator through the center apertures in the top wall and in the bottom wall with the gasket frictionally engaging the interior surface of the cylinder chamber sidewall. A disk holder is then provided and mounted to the universal connector on the cylinder shaft by a universal mount located at a center of the disk holder such that the disk holder tilts and follows the contour of a polishing pad when a conditioning disk is mounted thereon and when the disk holder is rotated by the cylinder shaft. In the method, a pneumatic pressure or vacuum may be applied to the cylinder shaft for moving the shaft in an up-and-down motion.

Figure 3:
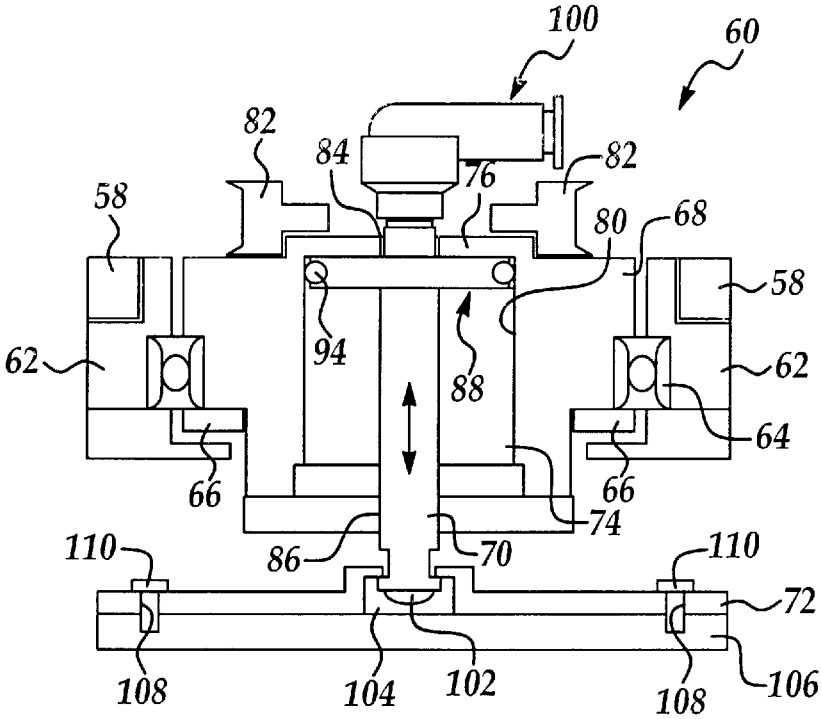
Figure 3 Prior Art
FIG. 3 is a cross-sectional view of the present invention conditioning head for a chemical mechanical polishing apparatus.

Referring now to FIG. 3, wherein a present invention conditioning head 60 is shown. The conditioning head 60 is constructed by a bearing mount 62, a ball bearing 64, a retaining ring 66, a cylinder rotator 68, a cylinder shaft 70 and a disk holder 72. As shown in FIG. 3, the bearing mount 62 is fixedly attached to an cover ring 58 that is part of a conditioning arm (not shown) in a CMP apparatus. The ball bearing 64 is also fixedly attached to the bearing mount 62 for mounting the cylinder rotator 68 therein and for allowing the cylinder rotator 68 to rotate on the ball bearing 64. The cylinder rotator has a cylinder chamber 74 which is defined by a top wall 76, a bottom wall 78 and a chamber sidewall 80. The cylinder rotator 68 is driven and rotated by a pulley member 82 situated on top of the cylinder rotator 68. The top wall 76 and the bottom wall 78 of the cylinder rotator 68 are both provided with center apertures 84 and 86 for providing a mounting means for the cylinder shaft 70.

Figure 5A:
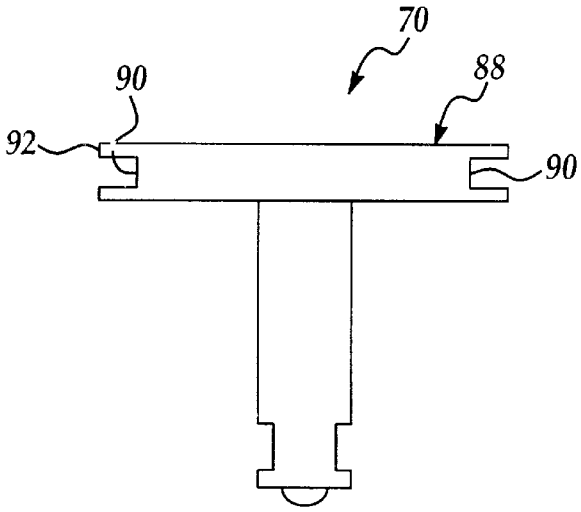
FIGS. 5A and 5B are cross-sectional and plane views of a cylinder shaft with a piston mounted thereon for the present invention conditioning head.
Figure 5B:
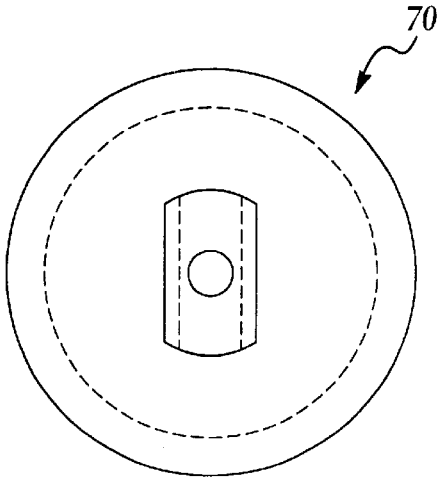

Also shown in FIG. 3 is the key component of the present invention novel apparatus, i.e. the cylinder shaft 70 which is equipped with a piston 88 attached at near a top end of the shaft 70. The piston 88, a detailed view of such is shown in FIG. 5A, is provided with a slot recess 90 in an outer rim 92 of the piston 88. Into the slot recess 90 is inserted a gasket member 94 which provides a sealing engagement, and a frictional engagement with the sidewall 80 of the cylinder chamber 74. The gasket 94 is normally fabricated of an elastomeric material and provides adequate flexibility and pliability for performing its sealing function. The gasket 94, while providing a sealing function against the sidewall 80 of the cylinder chamber 74, still allows the cylinder 88 to move up-and-down in the cylinder chamber 74 when the cylinder shaft 70 is activated by an air pressure or vacuum through the pneumatic conduit 100. This is shown in FIG. 3.

Figure 4A:
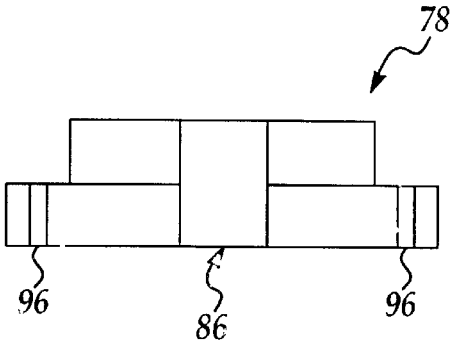
FIGS. 4A and 4B are cross-sectional and plane views, respectively, of a bottom wall of the cylinder rotator of the present invention conditioning head.
Figure 4B:
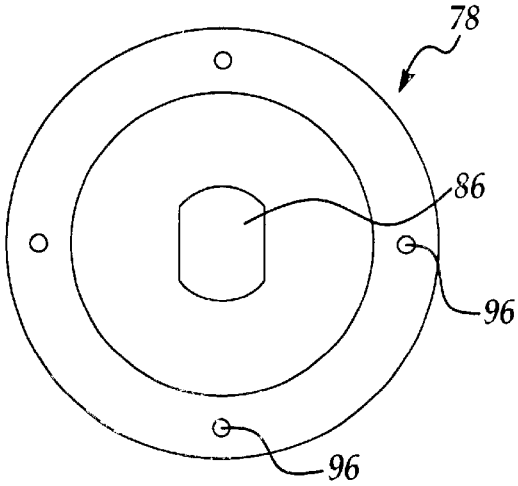
Figure 6A:
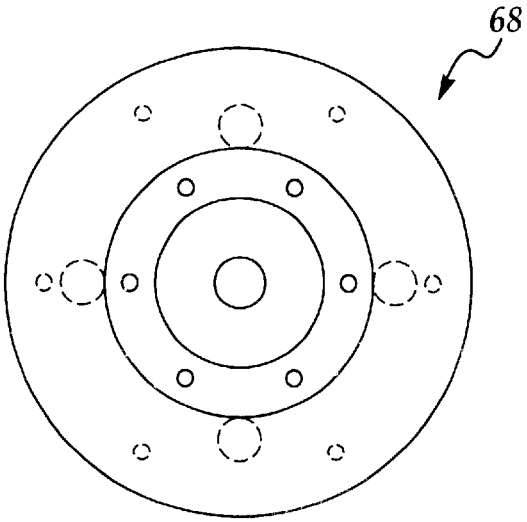
FIGS. 6A and 6B are cross-sectional and plane views, respectively, of the cylinder rotator for the present invention conditioning head.
Figure 6B:
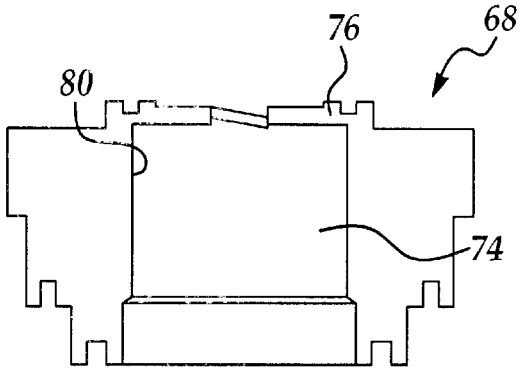
Figure 7A:
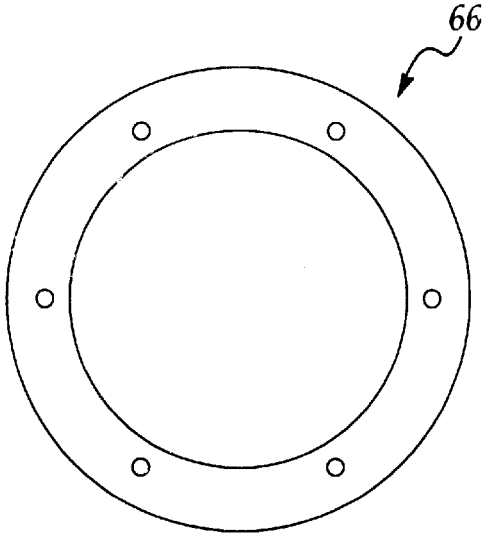
FIGS. 7A and 7B are cross-sectional and plane views, respectively, of the retaining ring for the present invention conditioning head.
Figure 7B:
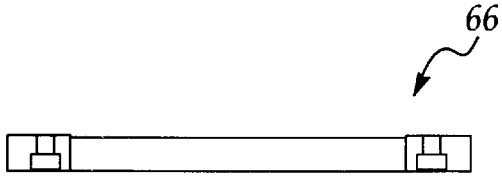

A detailed cross-sectional view and a plane view, respectively, of the bottom wall 78 for the cylinder rotator 68 are shown in FIGS. 4A and 4B. It is seen that mounting holes 96 are further provided for mechanically mounting the bottom wall 78 to the cylinder rotator 68. Similarly, a detailed plane view and cross-sectional view of the cylinder rotator 68, respectively, are shown in FIGS. 6A and 6B. In these detailed figures, dimensions utilized in the preferred embodiment of the present invention is also shown. However, it is understood that any other suitable dimensions may also be utilized as long as the spirit of the present invention is substantially followed. A plane view and a cross-sectional view of the retainer ring 66, respectively, are also shown in FIGS. 7A and 7B.

Figure 8A:
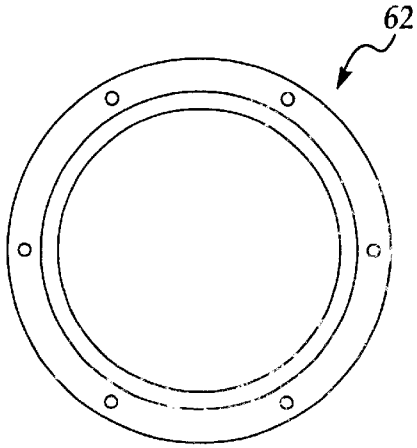
FIGS. 8A and 8B are cross-sectional and plane views, respectively, of the bearing mount for the present invention conditioning head.
Figure 9A:
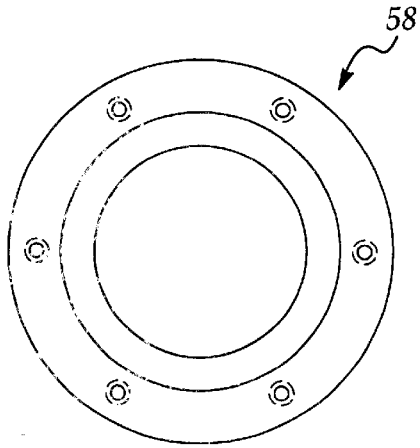
FIGS. 9A and 9B are cross-sectional and plane views of a cover ring for the present invention conditioning head.
Figure 8B:
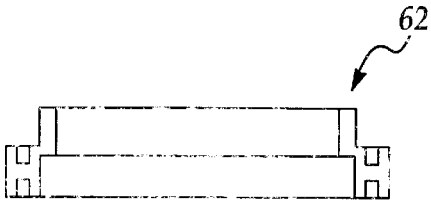
Figure 9B:
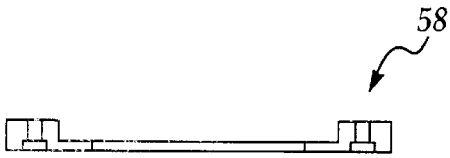

A plane view and a cross-sectional view of the bearing mount 62, respectively, are shown in FIGS. 8A and 8B, while a plane view and a cross-sectional view of the cover ring 58, respectively, are shown in FIGS. 9A and 9B.

Figure 10A:
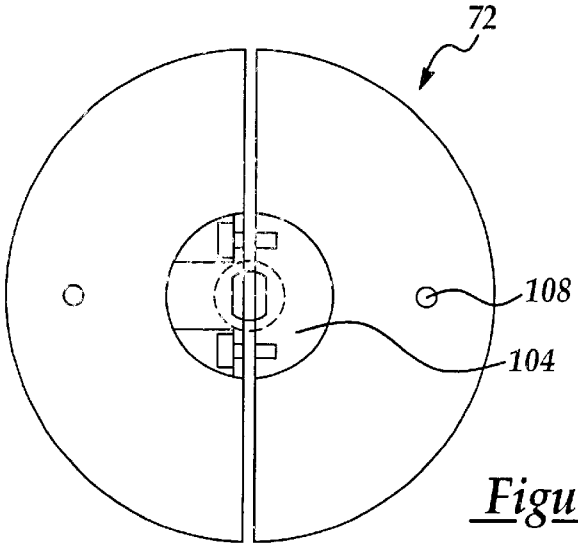
FIGS. 10A and 10B are cross-sectional and plane views of the disk holder for the present invention conditioning head.
Figure 10B:
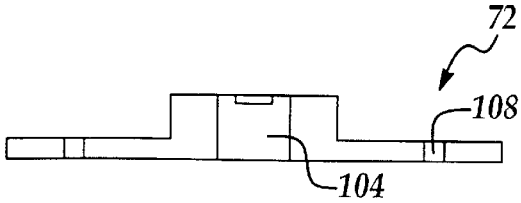

Referring now to FIG. 3, wherein a universal connector 102 is provided at a bottom end of the cylinder shaft 70. The universal connector 102 enables a flexible connection with a universal mount 104 provided at a center of the disk holder 72. These are further shown in FIGS. 10A and 10B in a detailed plane view and cross-sectional view, respectively. The engagement between the universal connector 102 and the universal mount 104 enables the present invention disk holder 72 to tilt and to follow the contour of a polishing pad when a conditioning disk 106 is mounted on the disk holder 72 and when the disk holder 72 is rotated by the cylinder shaft 70. This is another benefit made possible by the present invention novel structure.

The polishing disk 106 can be advantageously mounted to the disk holder 72 through mounting holes 108 by screws 110. In a preferred embodiment, the engagement between the universal connector 102 and the universal mount 104 allows the disk holder to tilt to at least ±30°, and preferably to at least ±45° from a horizontal plane such that any contour of a polishing pad can be followed to effectively condition the surface of the pad.

The pneumatic conduit 100 is connected to a pneumatic means which is capable of providing an air pressure of at least 5 psi, and preferably at least 15 psi for pressing the disk holder 72 downwardly for engaging the polishing disk 106 to the surface of a polishing pad (not shown). The pneumatic conduit 100 is further connected to a vacuum source such that the pneumatic means is operable by a negative air pressure of not higher than −15 psi, and preferably not higher than −10 psi for moving the disk holder 72 upwardly to disengage a conditioning disk 106 from the surface of a polishing pad.

The present invention novel cylinder shaft 70, equipped with the piston 88 and the elastomeric gasket 94 effectively moves up-and-down in the cylinder chamber 74 while engaging the sidewall 80 of the chamber. The sealing arrangement made possible by the gasket 94 prevents any possible leakage of a slurry solution in the cylinder chamber 74 from being siphoned into the pneumatic conduit 100 when a vacuum is applied to the system. This completely eliminates the processing problem frequently encountered in the conventional structure wherein an elastomeric diaphragm is utilized in sealing the cylinder chamber from the vacuum source.

The present invention novel apparatus and a method for mounting a conditioning disk to a conditioning head for use in a chemical mechanical polishing apparatus have therefore been amply described in the above description and in the appended drawings of FIGS. 3~10B.

While the present invention has been described in an illustrative manner, it should be understood that the terminology used is intended to be in a nature of words of description rather than of limitation.

Furthermore, while the present invention has been described in terms of a preferred embodiment, it is to be appreciated that those skilled in the art will readily apply these teachings to other possible variations of the inventions.

The embodiment of the invention in which an exclusive property or privilege is claimed are defined as follows:

What is claimed is:

1. An apparatus for mounting a conditioning disk in a chemical mechanical polishing (CMP) machine comprising:

a torroidal-shaped bearing mount for fixedly mounting to a conditioning arm in a CMP apparatus, said torroidal-shaped bearing mount being adapted to receive a ball bearing and a cylinder rotator that turns on said ball bearing;

a cylinder rotator having a cylinder chamber therein defined by a top wall and a bottom wall with center apertures therein for receiving a cylinder shaft;

a cylinder shaft having a piston mounted juxtaposed to a top end and a universal connector at a bottom end, said cylinder shaft being mounted through said center apertures of said cylinder rotator, said piston further includes a gasket for sealing between said piston and an interior surface of a cylinder chamber wall;

a disk holder for mounting to said universal connector on said cylinder shaft through a universal mount located in a top surface of said disk holder such that said disk holder may tilt and follow the contour of a polishing pad through a conditioning disk mounted thereon while rotated by said cylinder rotator; and a pneumatic means for applying to said cylinder shaft and for enabling an up-and-down motion of said cylinder shaft.

2. An apparatus for mounting a conditioning disk in a CMP machine according to claim 1, wherein said piston frictionally engages an interior chamber wall of said cylinder rotator by said gasket.

3. An apparatus for mounting a conditioning disk in a CMP machine according to claim 1, wherein said gasket on said piston being fabricated of an elastomeric material for providing frictional engagement between said piston and an interior chamber wall of said cylinder rotator.

4. An apparatus for mounting a conditioning disk in a CMP machine according to claim 1 further comprising a diamond disk mounted to a bottom surface of said disk holder.

5. An apparatus for mounting a conditioning disk in a CMP machine according to claim 1 further comprising a pulley for driving said cylinder rotator and causing it to rotate.

6. An apparatus for mounting a conditioning disk in a CMP machine according to claim 1, wherein said universal connector enables said disk holder to tilt at least ±30° from a horizontal plane.

7. An apparatus for mounting a conditioning disk in a CMP machine according to claim 1, wherein said cylinder rotator said cylinder shaft and said disk holder rotate as a single unit.

8. An apparatus for mounting a conditioning disk in a CMP machine according to claim 1, wherein said pneumatic means being operable by an air pressure of at least 5 psi for pressing said disk holder downwardly to engage a diamond disk to a polishing pad.

9. An apparatus for mounting a conditioning disk in a CMP machine according to claim 1, wherein said pneumatic means being operable by air pressure of not higher than −10 psi for moving said disk holder upwardly to disengage a diamond disk from a polishing pad.

10. An apparatus for mounting a conditioning disk in a CMP machine according to claim 1, wherein said ball bearing fixedly mounted to said bearing mount on a conditioning arm.

11. A method for mounting a conditioning disk in a chemical mechanical polishing (CMP) machine comprising the steps of:

providing a torroidal-shaped bearing mount fixedly mounted to a conditioning arm in a CMP apparatus;

providing a cylinder rotator having a cylinder chamber therein defined by a top wall and a bottom wall with center apertures for receiving a cylinder shaft;

mounting said cylinder rotator to said bearing mount with a ball bearing therein-between;

providing a cylinder shaft having a piston fixed thereon juxtaposed to a top end and a universal connector at a bottom end, said piston further includes a gasket for sealing between said piston and an interior surface of said cylinder chamber wall;

mounting said cylinder shaft inside said cylinder rotator through said center apertures in said top wall and said bottom wall with said gasket frictionally engaging an interior surface of a cylinder chamber wall;

providing and mounting a disk holder to said universal connector on said cylinder shaft by a universal mount located at a center of said disk holder such that said disk holder tilts and follows the contour of a polishing pad with a conditioning disk mounted thereon and when said disk holder being rotated by said cylinder shaft; and applying a pneumatic pressure to said cylinder shaft and moving said cylinder shaft in an up-and-down motion.

12. A method for mounting a conditioning disk in a CMP machine according to claim 11 further comprising the step of mounting said gasket on an outer rim of said piston.

13. A method for mounting a conditioning disk in a CMP machine according to claim 11 further comprising the step of fabricating said gasket from an elastomeric material and providing a fluid seal for slurry solution between said piston and an interior chamber wall of said cylinder rotator.

14. A method for mounting a conditioning disk in a CMP machine according to claim 11 further comprising the step of mounting a diamond disk to a bottom surface of said disk holder.

15. A method for mounting a conditioning disk in a CMP machine according to claim 11 further comprising the step of rotating said cylinder rotator by a pulley.

16. A method for mounting a conditioning disk in a CMP machine according to claim 11, wherein said universal connector enables said disk holder to tilt to a maximum of at least ±30° from a horizontal plane.

17. A method for mounting a conditioning disk in a CMP machine according to claim 11 further comprising the step of rotating said cylinder rotator, said cylinder shaft and said disk holder together as a single unit.

18. A method for mounting a conditioning disk in a CMP machine according to claim 11 further comprising the step of applying a pneumatic pressure of at least 5 psi for pressing said disk holder downwardly to engage a diamond disk to a polishing pad.

19. A method for mounting a conditioning disk in a CMP machine according to claim 11 further comprising the step of applying a pneumatic pressure of not higher than −10 psi for moving said disk holder upwardly to disengage a diamond disk from a polishing pad.

20. A method for mounting a conditioning disk in a CMP machine according to claim 11 further comprising the step of fixedly mounting said ball bearing to said bearing mount on said conditioning arm.

* * * * *